US011319773B2

(12) United States Patent
Candido Gomes

(10) Patent No.: US 11,319,773 B2
(45) Date of Patent: May 3, 2022

(54) FULLY ELECTRIC DOWNHOLE SAFETY TOOL

(71) Applicant: OURO NEGRO TECNOLOGIAS EM EQUIPAMENTOS INDUSTRIAIS S/A, Rio de Janeiro (BR)

(72) Inventor: Leonardo Gonçalves Candido Gomes, Maracana (BR)

(73) Assignee: OURO NEGRO TECNOLOGIAS EM EQUIPAMENTOS INDUSTRIAIS S/A, Rio de Janeiro (BR)

( * ) Notice: Subject to any disclaimer, the term of this patent is extended or adjusted under 35 U.S.C. 154(b) by 170 days.

(21) Appl. No.: 16/619,282

(22) PCT Filed: Jun. 5, 2018

(86) PCT No.: PCT/BR2018/050183
§ 371 (c)(1),
(2) Date: Dec. 23, 2019

(87) PCT Pub. No.: WO2018/223205
PCT Pub. Date: Dec. 13, 2018

(65) Prior Publication Data

US 2021/0324708 A1 Oct. 21, 2021

(30) Foreign Application Priority Data

Jun. 6, 2017 (BR) ..... 102017012026-0

(51) Int. Cl.
*E21B 34/06* (2006.01)
*E21B 34/14* (2006.01)

(52) U.S. Cl.
CPC ..... *E21B 34/066* (2013.01); *E21B 34/14* (2013.01); *E21B 2200/06* (2020.05)

(58) Field of Classification Search
CPC ..... E21B 34/066; E21B 34/14; E21B 2200/06
See application file for complete search history.

(56) References Cited

U.S. PATENT DOCUMENTS 6,253,843 B1 * 7/2001 Rawson ..... E21B 34/066 166/66.7
6,269,874 B1 8/2001 Rawson et al.
(Continued)

FOREIGN PATENT DOCUMENTS

BR PI 1020150275048 2/2017

*Primary Examiner* — Matthew R Buck
(74) *Attorney, Agent, or Firm* — Malin Haley DiMaggio & Bowen, P.A.

(57) ABSTRACT

A fully electric downhole safety tool comprising a valve for flow blockage in oil and gas wells completion operations under emergency conditions is described. Valve comprises an actuation array constituted by a hollow shaft motor, nut, spindle and sliding sleeve, so that upon starting, the opening movement of said array compresses a valve closure spring and places the flapper sealing in the open position, enabling communication to occur between zones and fluid to flow. To close the valve, as soon as the electrical supply is ceased, the string relaxes, the sliding sleeve, under spring force, returns as is the case for the whole of the actuation array, and flapper sealing is exposed to the flow so that valve returns to the closed position, physically blocking the flow.

3 Claims, 12 Drawing Sheets

(56) References Cited

U.S. PATENT DOCUMENTS

| | | | | |
|---|---|---|---|---|
| 6,719,057 | B2 | 4/2004 | Johansen | |
| 7,967,074 | B2 * | 6/2011 | Lake | E21B 34/066 166/386 |
| 10,982,506 | B2 * | 4/2021 | Eriksen | F16H 25/20 |
| 2004/0173362 | A1 * | 9/2004 | Waithman | E21B 34/066 166/386 |

* cited by examiner

FIG. 4
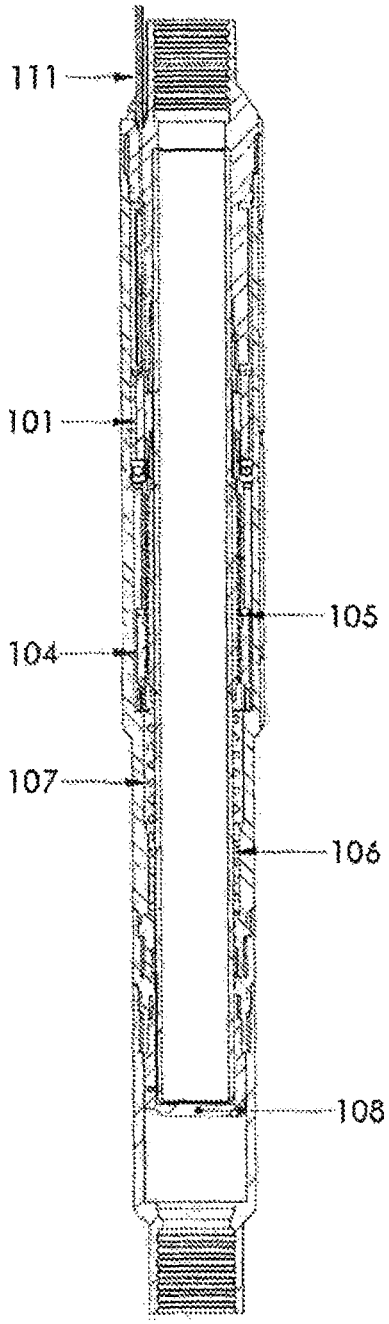
FIG. 4A
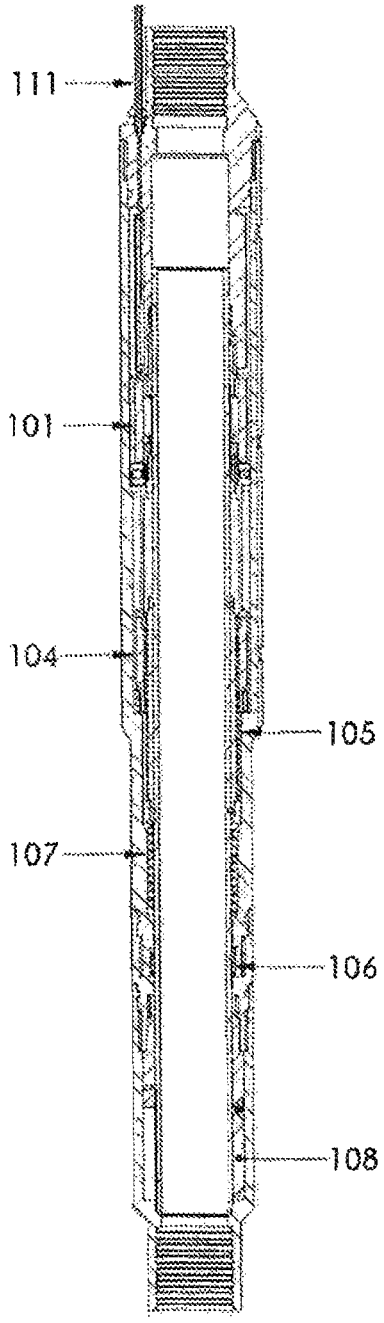
FIG. 4B

FIG. 5
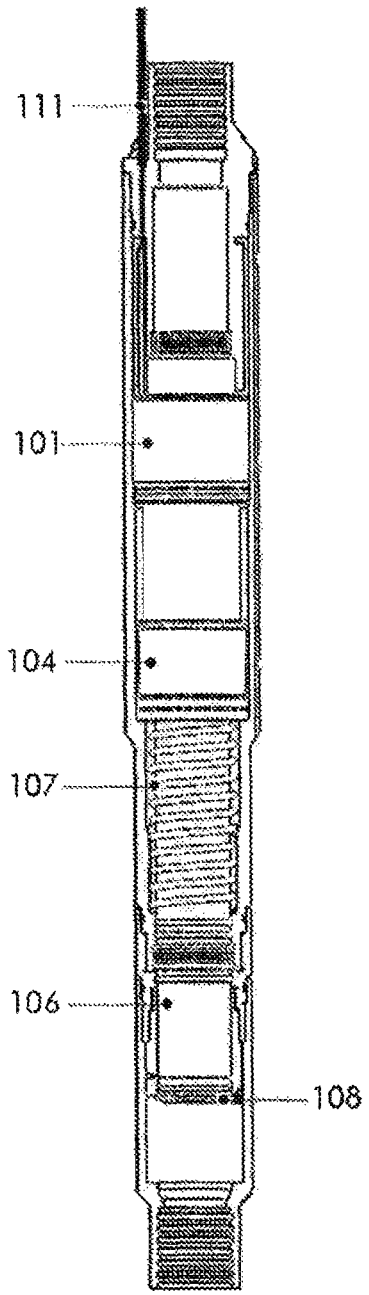
FIG. 5A
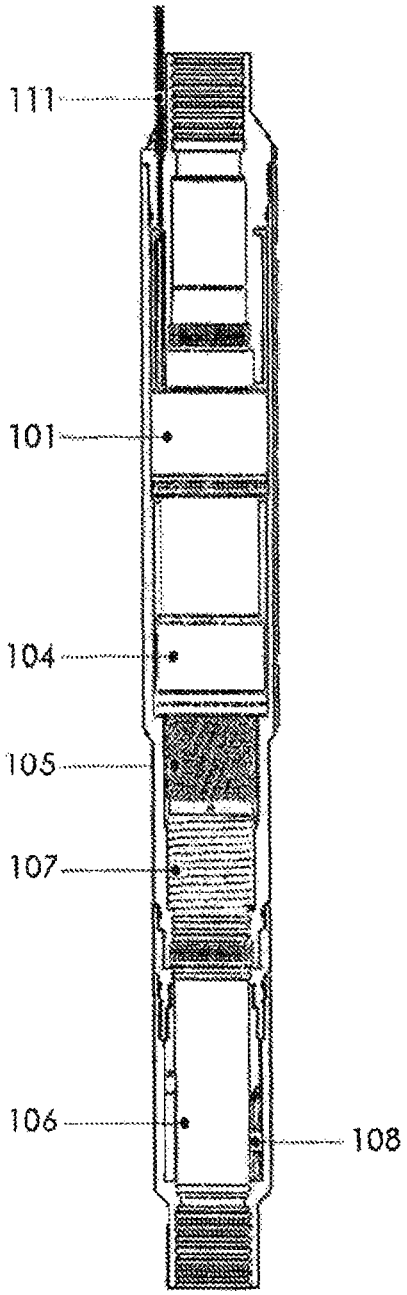
FIG. 5B

FIG. 6
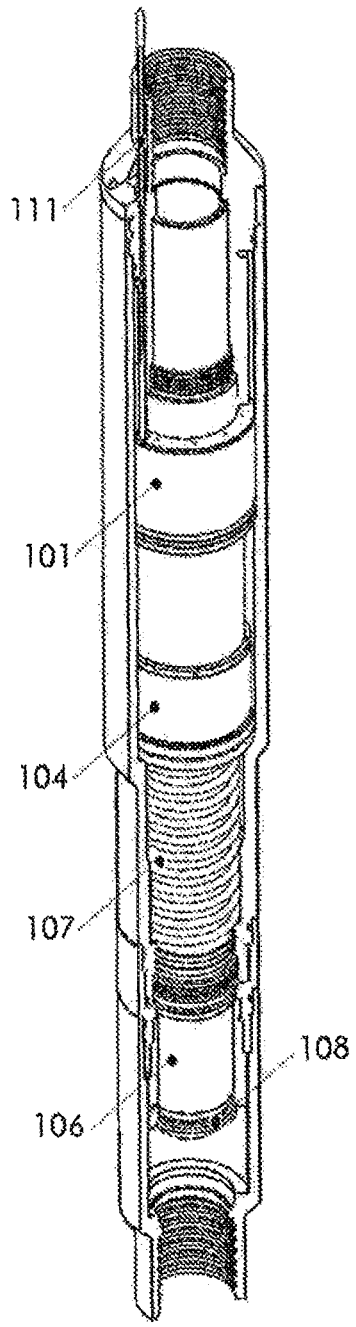
FIG. 6A
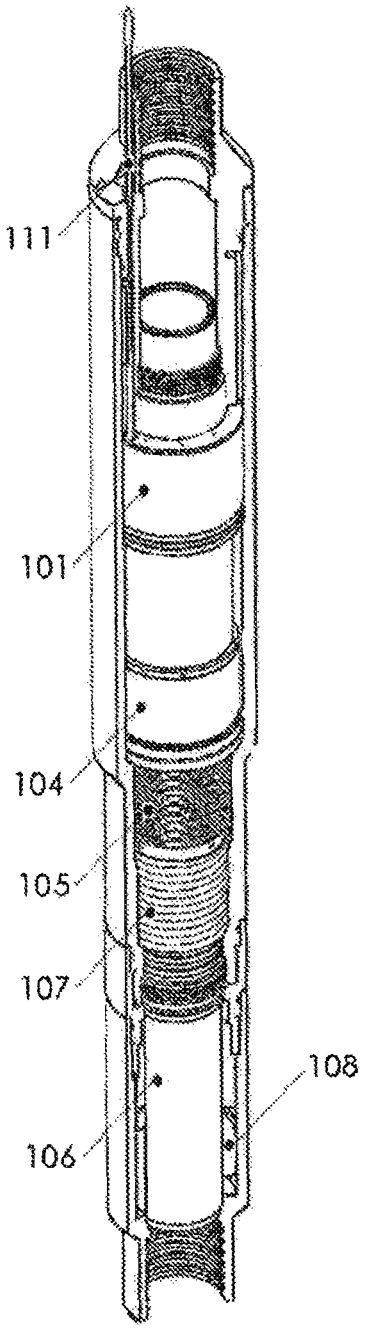
FIG. 6B

FULLY ELECTRIC DOWNHOLE SAFETY TOOL

CROSS REFERENCE TO RELATED APPLICATIONS

This applications claims priority to PCT application No. PCT/BR2018/050183 filed on Jun. 5, 2018, which claims priority to Brazilian Application No. BR102017012026-0 filed on Jun. 6, 2017.

BACKGROUND OF THE INVENTION

Field of the Invention

The present invention relates to a fully electrical downhole safety tool, the fully electrical tool including a fluid flow valve for well safety. The purpose of said valve is the well fluid flow blockage in case of string control impairment, resulting from accidents or failure, either of wellhead or of surface flow control equipment. The downhole safety valve object of the invention is applied both to land and offshore oil and natural gas wells completion operations.

Background of the Invention

Even though there is a constant search for alternative means of energy, there is still a need for producing a great amount of oil for worldwide demand.

One of the main aspects related to the oil and gas extraction is the wells completion systems. As a result of operational restrictions within wells, the complex functionality of completion tools is a challenge for technological companies of the oil and gas industries. Among such tools is the downhole safety valve (DHSV).

The downhole safety valve is necessary and mandatory to all of the flowing wells in Brazil and in many other places. Such valve comprises a tool to be applied to oil and gas wells as a protection against failure or accidents that could render inoperable the flow control tools placed either at the wellhead or at the surface. Being the first well safety envelope, such tool prevents the uncontrolled leakage of fluids outwards the well, preventing environmental pollution and protecting operations at the surface.

In most Brazilian oil wells, the downhole safety valve is remotely operated and hydraulically actuated via a primary actuating system comprising one hydraulic power unit and first or main and second control lines, the second one being redundant to the main one, or just for balancing or equalization. By applying hydraulic pressure to the main control line, the flapper sealing is opened and, upon pressure cessation, the valve returns to its initial closure status.

A further well-known device is the multiplex control system where an electrical device is in charge of directing the hydraulic power arriving by a line, thus reducing the number of lines required for the system control; however, there is still the need to use hydraulic power and the infrastructure required for the actuation. As a result of the technological progress and the need of improving the well control process, the industry is now seeking fully electric downhole safety valves.

The operation of the hydraulic downhole safety valve comprises applying pressure to a hydraulic piston (balanced or not) attached to a sliding sleeve. Whenever pressurized, the piston is displaced towards the opening (generally downwards in the axial direction), promoting on its turn, the displacement of the sleeve to which it is attached, and compressing the return system (that absorbs energy); in this way, the sleeve freely moves the flapper sealing, which generally is in the form of a flapper or sphere, making it go from the closed position to the open position, and thus allowing the passage of fluid.

The valve of the invention for downhole safety is characterized by its configuration, which renders it normally closed as a result of the return system, performed by a string (with or without nitrogen chamber and/or other aid system) or any other cumulative system, and by the flapper sealing element. Whenever moved, the sleeve compresses the return system (considered in the present Application as a spring which accumulates energy. As soon as the valve actuation power is ceased, the previously compressed return system relaxes, thereby promoting the return of the opening device (sleeve/piston) and thus the return of the blocking system. Such system is kept in the closed position due to the pressure differential between the two sections (upper and lower relative to the flapper sealing). In this way the flow throughout the production string is physically interrupted.

At present the downhole safety valves exhibit a high number of drawbacks, most of them at the hydraulic actuation system, such as control line, piston chamber or piston itself blockages or leakages.

Such drawbacks impart huge damages to the production chain and produce high risks to the safety of the environment around. The unnecessary closure of the downhole safety valve represents an unexpected production stop, with huge losses. Whenever a well intervention is required for maintenance or replacement of the damaged element, external ships support (such as a rig in high sea) or support and operation vehicles (on land) become necessary, which leads to high costs, besides increased risks during positioning and installation of the intervention equipment.

In a few cases of failure of the downhole safety valve, when correction maintenance is not feasible, aiming at avoiding withdrawing the completion string, a risk analysis is performed based on the kind of operation and well location and behavior. In case the analysis complies with the requirements, a device for blocking the flapper sealing in the open position is installed to keep the valve as such. This procedure renders useless the downhole safety valve and increases the risks to the integrity of equipment, workers and environment around, since a safety barrier has been removed. In spite of the flapper sealing blockage, still a well intervention is required for the installation of the blockage device, aggregating all the risks and expenses involved in such operations. However, completion string removal becomes unnecessary for maintenance or replacement of the downhole safety valve, since this would be more time consuming and leading to higher costs and losses.

The replacement of the hydraulic actuation system for the downhole safety valves by a fully electric system provides many advantages. Among these, there is the lack of need of a hydraulic power unit and of all the infrastructure required for power transmission, which in general leads to (aggregates) high costs, high energy consumption and space occupation, which is restricted. Further, dependability is increased due to the actuation system which will be free from all of the drawbacks related to hydraulics, such as blockages and leakages, among others. Also, the electrical system bears a response velocity higher than that of the hydraulic one, reducing risks and damages incurred in emergency situations.

A fully electric actuating system for a downhole safety valve requires higher investments than a similar, hydraulically-actuated, conventional downhole safety valve. However, by making viable a true dependability increase, by reducing the number of drawbacks in the actuating system and therefore reducing the number of well interventions the financial return is higher as compared to the amount invested in the tool. Still, the safety level is high as compared with the number of well interventions.

As far as the present oil and gas market is concerned, in spite of the availability of a few fully electric completion systems, such systems are operated in an extremely reduced scale as compared with similar hydraulic or multiplexed (electro-hydraulic) systems. Even so, most of the few tools available as downhole safety valves providing for electrical actuation make use of a piston which in a secondary way actuates a sliding sleeve, which in turn actuates the flapper sealing.

There are a few kinds of downhole safety valves of electrical actuation, among which it is worthwhile to mention the U.S. Pat. Nos. 6,253,843; 6,269,874; 6,619,388 patents and published U.S. Application U.S. 2004/0173362A1, all of them making use of motors to indirectly actuate the downhole safety valves. However, whenever such motors are employed, these bear state-of-the-art configurations, being connected either to nuts and spindles or to pressurizing units and piston, located at the valve side (radially), so that the available space is not entirely exploited. Advantageously, in a way which differs from the cited state-of-the-art documents, by making use of a hollow shaft motor, it is possible to obtain higher torque, higher efficiency and higher dependability, in part, derived of the simpler configuration provided for by the hollow shaft motor.

U.S. Pat. No. 6,719,057 is about the possibility of installing the actuator component close to the flow control equipment at the surface, this concept being entirely different from that of the present invention. According to said patent document, the opening valve energy is hydraulic, obtained by means either of an array of motor (electrical or not) and pressurizer (hydraulic pump) or motor (electrical or not), spindle and piston.

U.S. Pat. No. 7,967,074 describes an electrical, insertable (removable) downhole safety valve, which also differs from the present concept since the object of said document is not focused on the actuation system.

On the other hand, the use of a hollow shaft motor inside a valve was the object of Brazilian Patent Application PIBR1020150275048 of the Applicant, it being completely incorporated herein as reference. The present Application differs from such prior Brazilian Patent Application in that, in the present Application, the hollow shaft motor is included in a downhole safety valve, the motor function being limited to, whenever actuated, positioning and keeping open a flapper (and for that end making use of a sleeve). As soon as the said hollow shaft motor is deactivated, a passive secondary system will provide for the return of the actuation array, triggering the flapper closure and consequent physical blocking of the string. The main advantage of such system is the high dependability, since it has just one actuation position for the hollow shaft motor.

Further, according to Brazilian Patent Application PIBR1020150275048 of the Applicant, its main object is the flow control by means of the position control together with an infinitely variable flapper sealing.

Still referring to the differences between the inflow control valve object of the above-cited Brazilian Patent Application PIBR1020150275048 and the present Application, the downhole safety valve of the present invention actuates in only two positions, counting on an independent return system (which qualifies it for such purpose). Further, said valve should necessarily be "energized" to be kept open. The hollow shaft motor system improves the dependability degree (this being the main aspect related to said kind of tool). Whenever actuated, the sleeve slides to block the flapper in the open position, enabling the communication between the two production string zones to occur. On the contrary, in the inflow control valve—the object of said prior Brazilian Patent Application—, the main purpose is having a refined and accurate positioning variation, which combined to the infinitely variable flapper sealing would allow for the area control available for flow, therefore controlling flow between annular and string.

In this way, the present invention, such as described and claimed in the present Application, differs from the whole of the available, state-of-the-art technique in view of the hollow shaft motor being applied to a twin-position safety tool. Such concept leads to higher efficiency, better forces distribution, and higher relevance for obtaining higher dependability throughout the chain to which it belongs.

The present tool with valve aims at blocking the well fluid flow in case of completion string control loss, caused either by accidents or failure of wellhead or surface flow control devices. Thus, the success of the principle of the actuating component as a hollow shaft motor, rendering possible the passage of the sliding sleeve throughout the interior of said motor to make viable a fully electric control valve, would not be evident or assured towards other circumstances or applications. This is true in view of the fact that the present valve operates under circumstances which differ from those of the above-cited Brazilian Patent Application PIBR1020150275048, where the valve is intended for the oil flow control, gradually opening and closing.

SUMMARY OF THE INVENTION

Broadly, the present invention deals with a tool which is a fully electric downhole safety valve, said valve being physically characterized by the actuating component being a hollow shaft motor, the interior of which allows the passage of a sliding sleeve.

Therefore, according to the invention, the fully electric downhole safety valve tool, for flow blockage in oil and gas wells under emergency situations, comprises a tubular-shaped housing, and, contained within said housing:

- A sliding sleeve with a tubular body provided with seals at both of its ends, a spindle being attached to the said sleeve tubular body in order to allow displacement in the axial direction, said spindle being actuated by means of the rotation of a nut coupled to a transmitting element, and wherein said sleeve is contained in the interior of a hollow shaft motor generally made up of a stator and a rotor;
- An element called a coupling ring in charge of transmitting the rotation of said hollow shaft motor to the said transmitting element;
- At least one electronic control, monitoring and communication device, in charge of the actuation of said hollow shaft motor by acquiring data provided by sensors, if any, and by the continuity of the well electrical line whenever necessary;
- a blockage component in charge of the string mechanical opening and closure, said component having the format of a flapper;
- A sealing base where the blockage component in the flapper format is positioned, and upon closure of same, it is forced against said sealing base, thus promoting the string blockage and sealing between zones;

At least one key designed for restricting the radial movement of the sleeve (rotation) thus forcing movement in the axial direction;

At least one roller bearing designed for supporting the axial charging and keeping the radial alignment;

A spring in charge of acting as return system of said sliding sleeve; and

An electrical cable for supplying power to said valve.

Therefore, the present invention provides a downhole safety valve for flow blockage in gas and oil wells under emergency conditions, said valve being provided with fully electric actuation by means of at least one line (in this case, the only line is the main line) of electrical power, free from hydraulic lines. In this way, there is no need of a surface hydraulic power unit as well as infrastructure for transmission of said power.

The invention provides further a valve to be applied in the format of downhole safety, the configuration of which is such as to render it normally closed, as a result of the return system performed by a spring (with or without nitrogen chamber and/or any other aid system) or any other cumulative system, and a blocking element.

The invention provides also a downhole safety valve where, when said valve is moved, the actuation system sleeve compresses the return system (spring) which accumulates energy. As soon as the valve actuation power is ceased, the previously compressed return system acts to promote the return of the opening device (sleeve/piston) and therefore the return of the blocking system. Such system keeps the closed position due to the pressure differential between the regions positioned upwards and downwards to the flapper sealing, so as to physically interrupt the flow throughout the production string.

The invention provides therefore a downhole valve where the improvement in the tool dependability degree is due to the actuation format in which the hollow shaft motor will be employed—just one position.

Alternatively the invention provides for that the whole of the control system is installed at the surface, improving still further the dependability degree and making it easier for the equipment maintenance when the damage is located at the electronic system. Advantageously, the actuation system of the present tool as a safety valve is of improved dependability resulting from the absence of drawbacks related to hydraulics, including control lines leakages and blockages.

BRIEF DESCRIPTION OF THE DRAWINGS

FIG. 4 attached is a front elevational view of the same valve in the closed position (FIG. 4A) and in the open position (FIG. 4B).

FIG. 5 attached is a view in the plane in partial cut of the same valve in the closed position (FIG. 5A) and in the open position (FIG. 5B).

FIG. 6 attached is an upper perspective general view as a partial cutaway, of the same valve in the closed position (FIG. 6A) and in the open position (FIG. 6B).

DETAILED DESCRIPTION OF THE INVENTION

The present invention is directed to a downhole safety tool, more specifically, to a downhole safety valve, having as a main object the application of an actuation system, performed by a hollow shaft motor to a safety tool in wells, said tool being defined as normally closed. Advantageously, the actuation system of said downhole safety valve is fully electric.

The proposed safety valve is directed to production (completion) operations in land and offshore oil and gas production or injection wells, flowing or not.

The application of the actuation system of the safety valve, which is the object of the invention, is not limited to opening and closure tools such as valves. On the contrary, the concept of actuation with the aid of a hollow shaft motor is useful in other components of the completion string.

The hollow shaft motor concept as applied to completion string elements is interesting since it renders possible, directly or indirectly, the electric actuation of a tool by means of the torque generated by the hollow shaft motor.

Further, the hollow shaft motor configuration enables the free string physical continuation, being therefore positioned in the annular space while the main string passage occupies the inner, radial region.

According to the concept of the invention, in the downhole safety valve of the invention, the sleeve, in an entirely new, non-previously suggested nor disclosed way for downhole safety valves, traverses a motor (FIGS. 4A and 4B). For doing so, use is made of a hollow shaft motor which enables such valve configuration, with huge advantages, as will be made more evident throughout the present specification.

The invention will now be described by reference to the attached Figures.

Figure 8A:
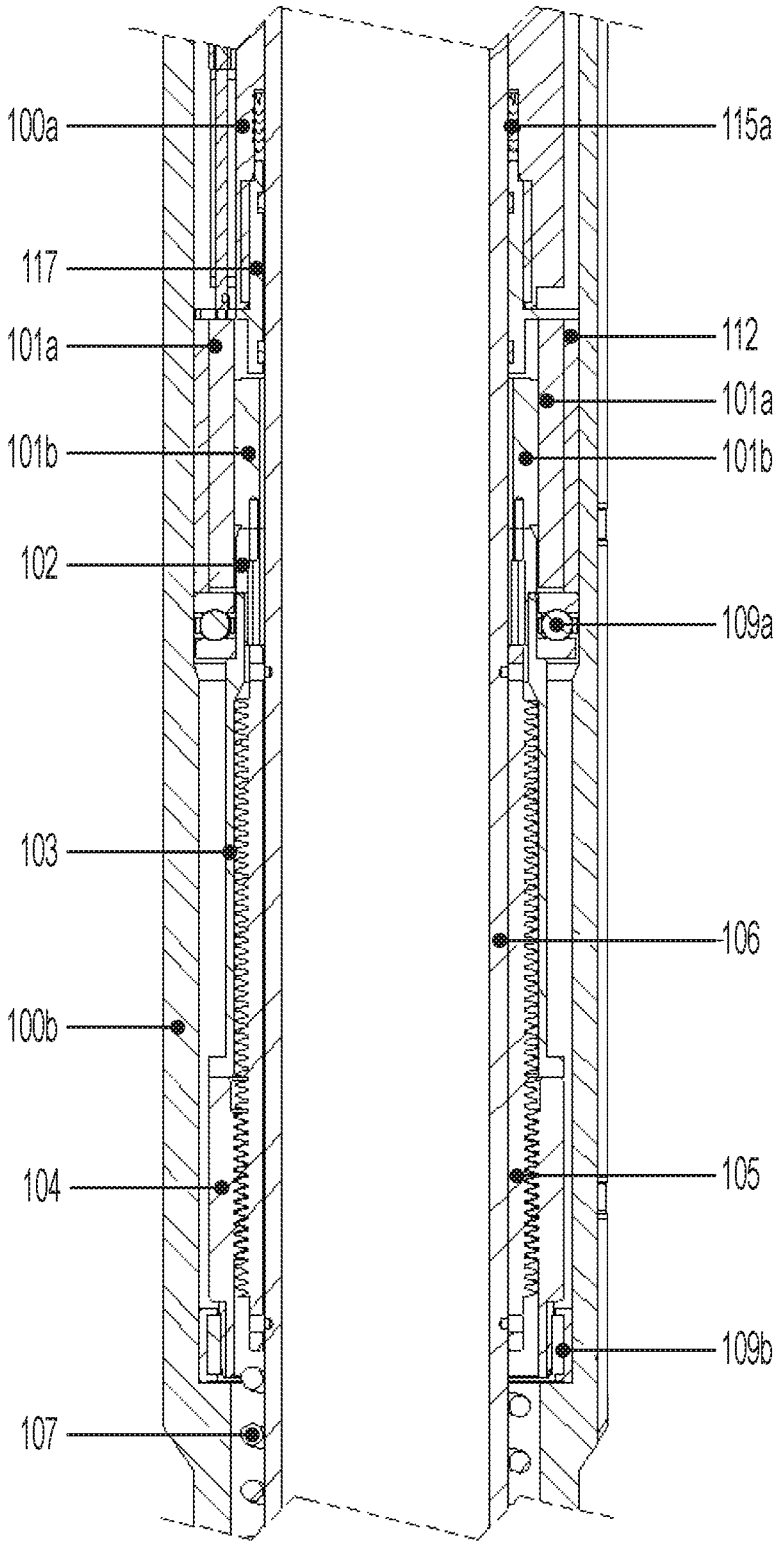
FIGS. 8A and 8B attached are a front view in a detailed cut of the valve of the invention depicting the electric actuation system in the closed position (FIG. 8A) and in the open position (FIG. 8B).

The downhole safety valve 200 object of the present invention, inserted in the interior of a housing includes a hollow shaft motor 101, said motor 101 comprising a stator 101*a* and a rotor 101*b*. (FIG. 8A)

Figure 1:
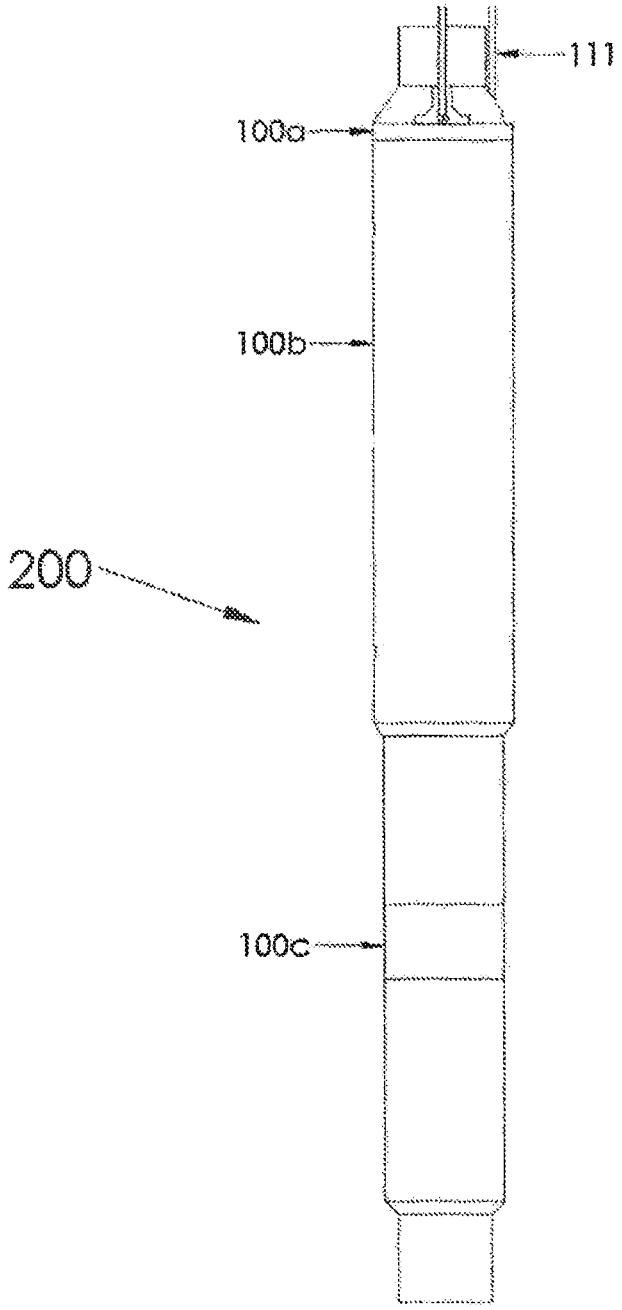
FIG. 1 attached is a general elevational view of the tool of the invention.
Figure 2:
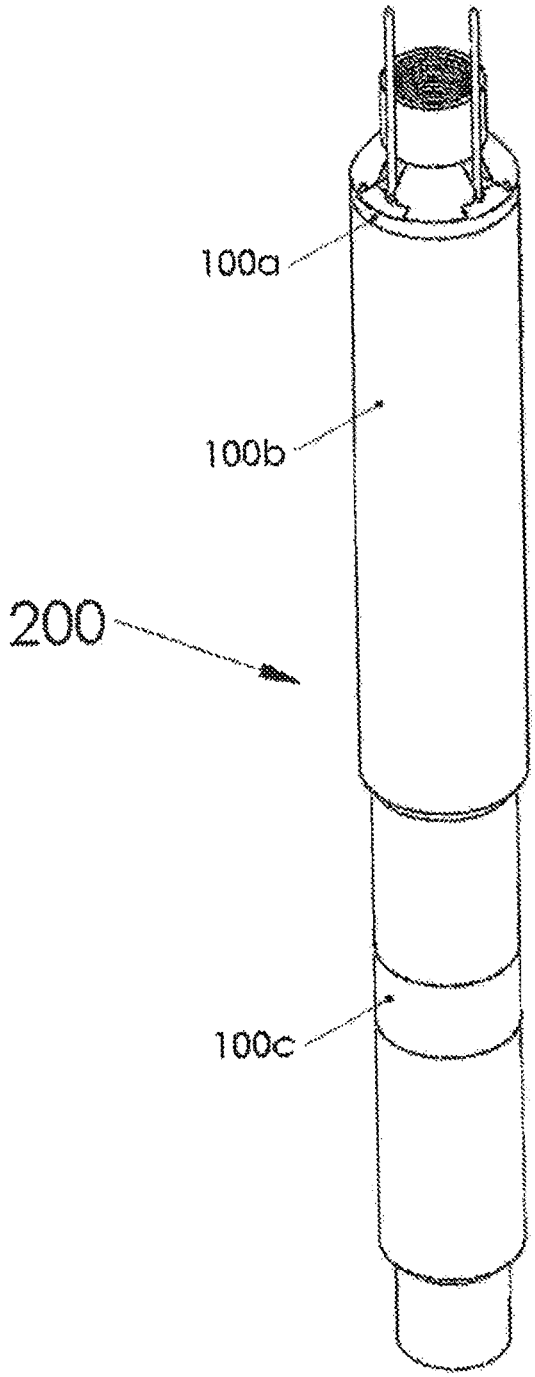
FIG. 2 attached is a perspective general view of the tool of the invention.
Figure 3:
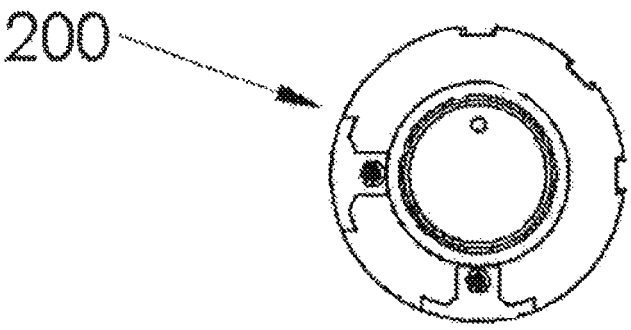
FIG. 3 attached is a general plan end view, in the plane of the upper cross section of the valve of the invention.

Housing comprises an upper section 100*a*, an intermediate section 100*b* and a lower section 100*c* (FIG. 1 and FIG. 2).

Rotor 101*b* is the mobile component in charge of transmitting the torque generated by the hollow shaft motor to the actuation system, as will be described in further detail below.

Stator 101*a* is connected to an attachment collar 112, said attachment collar 112 being cooperatively attached to the upper section 100*a* of the housing.

According to one embodiment of the invention, rotor 101*b* is attached to a coupling ring 102 connected to a transmitter 103 which in turn is attached to a nut 104.

When the hollow shaft motor 101 produces torque, the generated torque is transmitted to nut 104 by means of coupling ring 102 which mechanically connects rotor 101*b* to transmitter 103, the transmitter 103 being mechanically attached to said nut 104.

Upon starting of the rotation movement, movement is transmitted to a spindle 105 attached to a sliding sleeve 106, said sliding sleeve 106 being provided with at least one restriction related to the rotation movement (radial direction). In the present invention, said restriction is represented by a key 114. It should be clear for the experts that this configuration is not a limiting aspect of the invention and that said configuration is not an object of the invention.

In this way the torque applied by rotor 101*b* results into axial movement due to the action of the nut 104 and spindle 105 set.

The actuation direction as defined in the present document is the axial, downwards direction. However, it should be clear for the experts that such actuation direction is not a limiting aspect of the invention and that said direction is not an object of the invention.

Upon displacement of said sliding sleeve 106 downwards, spring 107 is compressed, spring 107 being defined as return system. Spring 107 is maintained under compression at all times the downhole safety valve 200 is kept open.

Figure 9A:
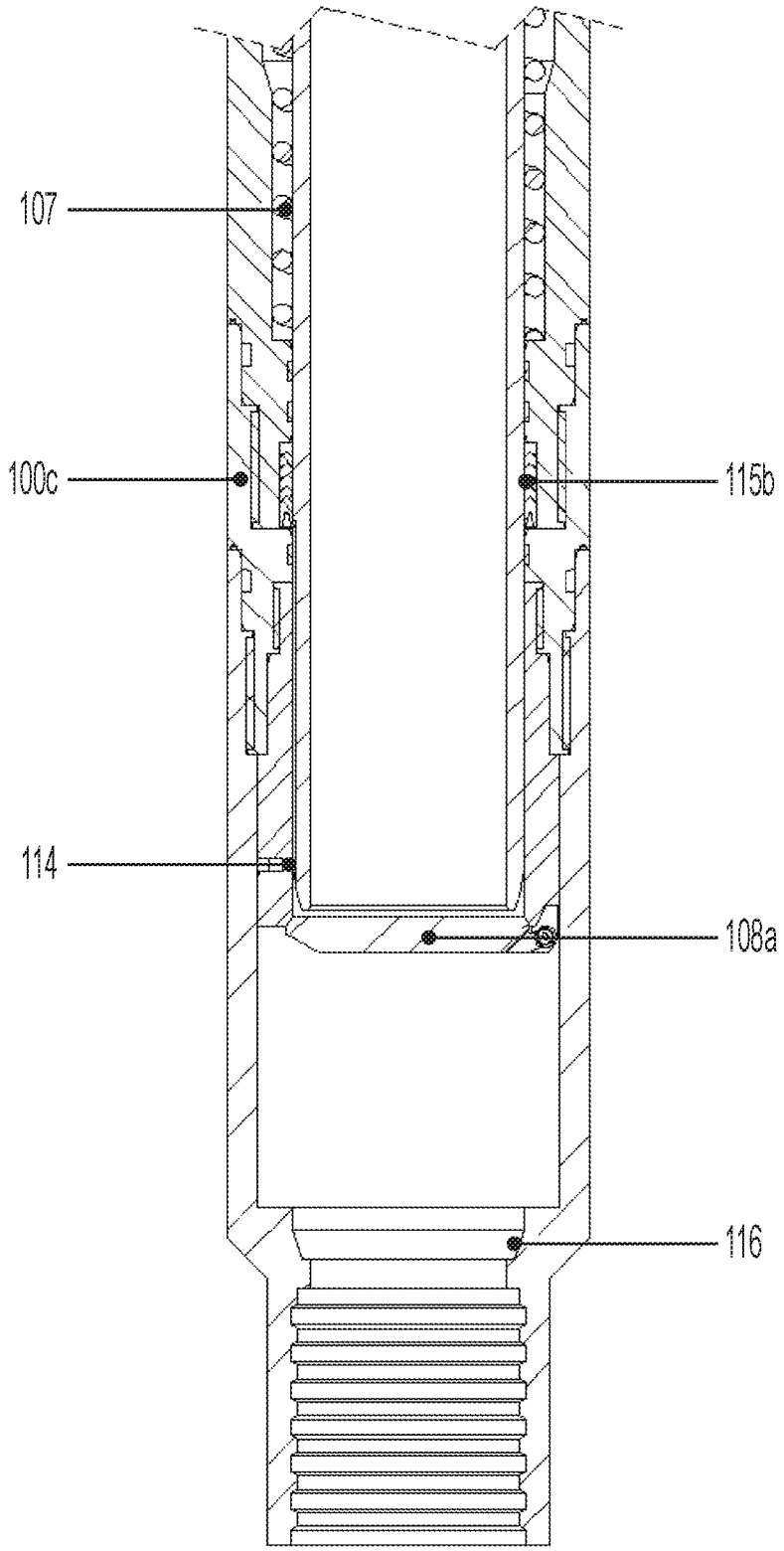
FIGS. 9A and 9B attached are front views in a detailed cut of the valve of the invention depicting the mechanical blocking system and mechanical return in the closed position (FIG. 9A) and in the open position (FIG. 9B).
Figure 9B:
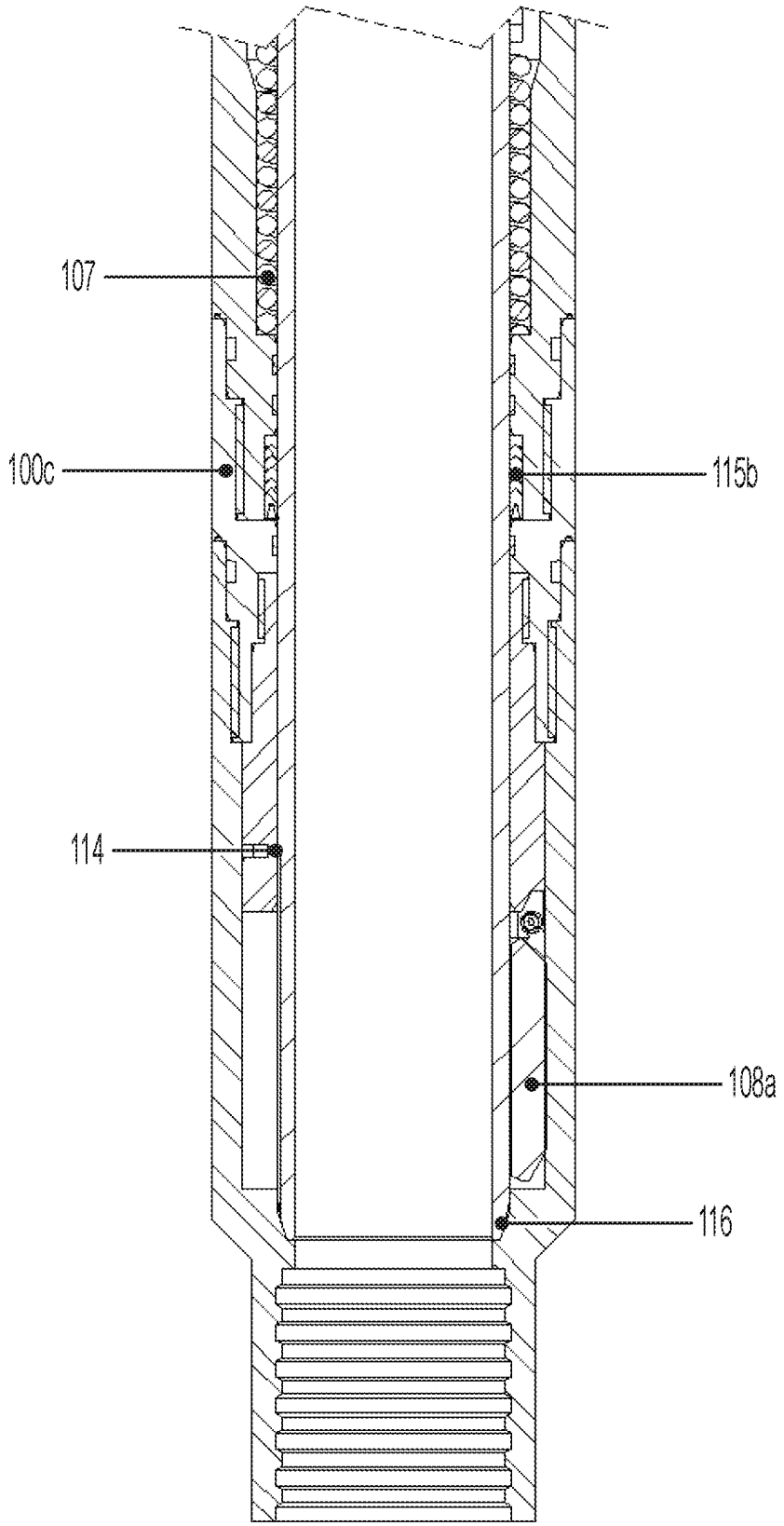

Upon sliding downwards, the displacement of said sliding sleeve 106 leads to the opening of a flapper sealing 108 by means of mechanical contact (FIG. 9A), which is in a non-limiting way a flapper 108*a*, the flapper being stopped at the sliding sleeve 106 end stop. In this way, both the flapper 108*a* and the sealing base 113 are protected by said sliding sleeve 106 from excess wear caused by the produced fluid flow, which most of the time contains a high amount of debris (FIG. 9B).

In this way, the configuration of the valve of the invention makes certain that it is normally closed as a result of the return system provided for by the spring 107 and the flapper sealing 108.

Upon being displaced, sleeve 106 compresses the return system (spring 107) which accumulates energy. As soon as the actuation power of the valve is ceased, the previously compressed return system relaxes, promoting the return of the opening device (sleeve 106/nut 104) and thus the return of the blocking system.

The sealing base 113 is a support for the blocking element (flapper sealing) 108 represented by a flapper 108*a*. When flapper 108*a* is in the closed position, it is compressed against said base 113 influenced by pressure, thus promoting flow blockage among string zones.

In order to keep the downhole safety valve 200 in the open position, the hollow shaft motor 101 is provided with a magnetic induction electronic brake, so that there is no need to keep the hollow shaft motor 101 actuating at maximum power throughout the whole of the opening period.

Further, the downhole safety valve 200 of the invention may also contain a braking aid system (not represented) actuating in the open position. This aims at reducing the required power to keep the valve in said position (spring 107 in the compressed state). The braking aid system can take various embodiments, the most well-known and widely used in the valve industry being the Collet system, which per se is not an object of the invention.

Figure 8B:
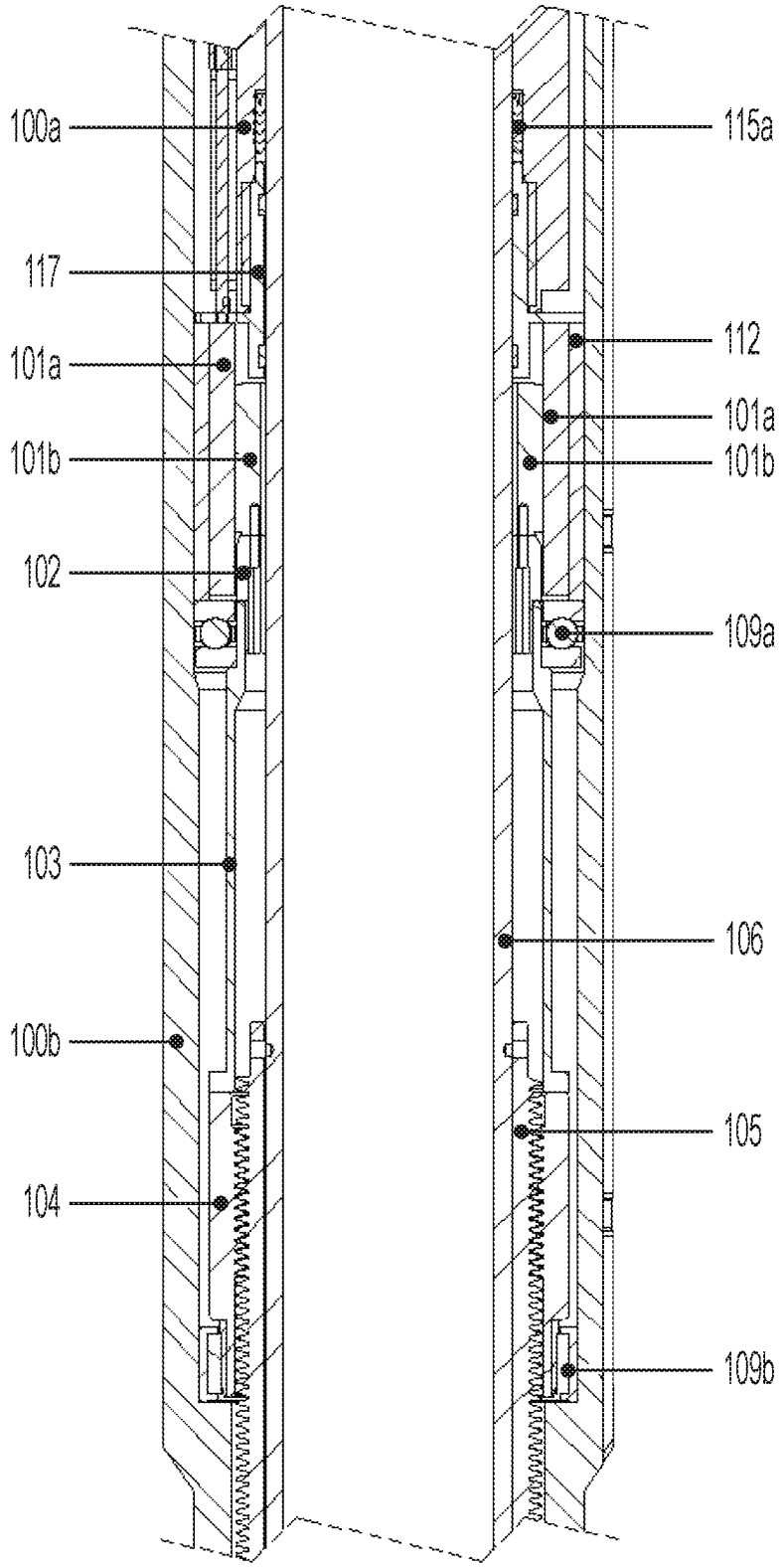

In short, the actuation array (FIGS. 8A and 8B) of the invention is composed by the hollow shaft motor stator 101*a* and rotor 101*b*, nut 104, spindle 105 and sliding sleeve 106. Upon starting the opening movement, said actuation array compresses spring 107 and places flapper 108*a* in the open position, enabling the fluid to flow.

After energizing is ceased, the electric power low-consumption braking system of the hollow shaft motor is disabled. In this way the previously compressed spring 107 relaxes, acting on the actuation array and performing the return of said sliding sleeve 106. Thus the flapper 108*a* (FIGS. 9A and 9B) is exposed to flow and through the geometric interaction of same with the fluid flow in the string (fluid dynamic interaction), returns to the closed position. For this reason, the completion string is mechanically blocked and is kept in this position because of the pressure differential between the two end (upper and lower) sections of the completion string.

It should be clear for the experts that the direction in which the said sliding sleeve 106 moves has been arbitrarily set, but it is not by any means restricted to the selected direction. Thus the opening direction may vary according to the kind of well, either a production well as described in the present Application or an injection well. Additionally and alternatively, the opening direction varies with the torque direction of the hollow shaft motor rotor 101*b*.

Therefore, in operation, said actuation array, upon starting the opening movement, is displaced downwards, compressing spring 107 and mechanically pushing flapper sealing 108, in order to place the same in the open position and enable communication to occur among zones, and therefore fluid to flow.

Alternatively, in operation, the sliding sleeve 106, upon starting the opening movement, is displaced upwards.

The actuation array according to the invention may be applied to the downhole safety valves to be employed either in production or injection wells, be they flowing wells or not. To do so, as a function of the well features, slight modifications of the flapper sealing would be required, both in the opening direction and the return system. Note that none of these aspects are being independently considered as innovation or object of the invention in the present Specification, since they belong entirely to the scope of the present invention.

As mentioned above, in the present invention the actuation array is not restricted to the type of flapper sealing 108*a*, arbitrarily defined in the present Specification as being in the format of flapper 108*a*.

Besides, the coupling ring 102 and transmitter 103 elements are not relevant to the present invention, being instead parallel elements designed for the transmission of torque generated by the said hollow shaft motor rotor 101*b* to nut 104. Such elements represent therefore a viable, non-limiting alternative of assembly for valve 200. Therefore, in accordance with one embodiment of the invention, it is possible to attach the nut 104 directly to rotor 101*b* in a way which is not represented in the present Specification, while suppressing the coupling ring 102 and transmitter 103 elements.

For the spindle 105/nut 104 system, several technologies are available, such as planetary spheres, planetary rolls spindles, trapezoid screws, among other technologies, this aspect not being critical to the invention and not being an object of same.

The movement in the direction of the sliding sleeve 106 rotation is provided of at least one restriction, and for the purposes of the present invention, the restriction element adopted is key 114, allowing movement only in the axial direction of the downhole safety valve 200, as already mentioned above in the present Specification. Guides or similar devices are completely acceptable for the purposes of the present invention, such variations not being represented in the invention, since they are well-known by the skilled person. In this way, by applying said key 114, all of the torque of said hollow shaft motor 101 will be transmitted as linear force throughout the spindle 105, generating an axial movement of the sliding sleeve 106.

Alternatively, spindle 105 is manufactured in the sliding sleeve 106 itself, making the two components one single element.

As reported above in the present Specification, the hollow shaft motor 101 is provided with a magnetic induction electronic brake to aid in keeping open the downhole safety valve 200. To this end the electric supply of the hollow shaft motor 101 is required to keep said valve static, that is, to keep said valve open.

The electric supply of said downhole safety valve 200 is provided by at least one TEC cable 111. A TEC cable is a commercial cable designed for well applications. Further, a second TEC cable 111 is possible for the sake of redundance.

Figure 7A:
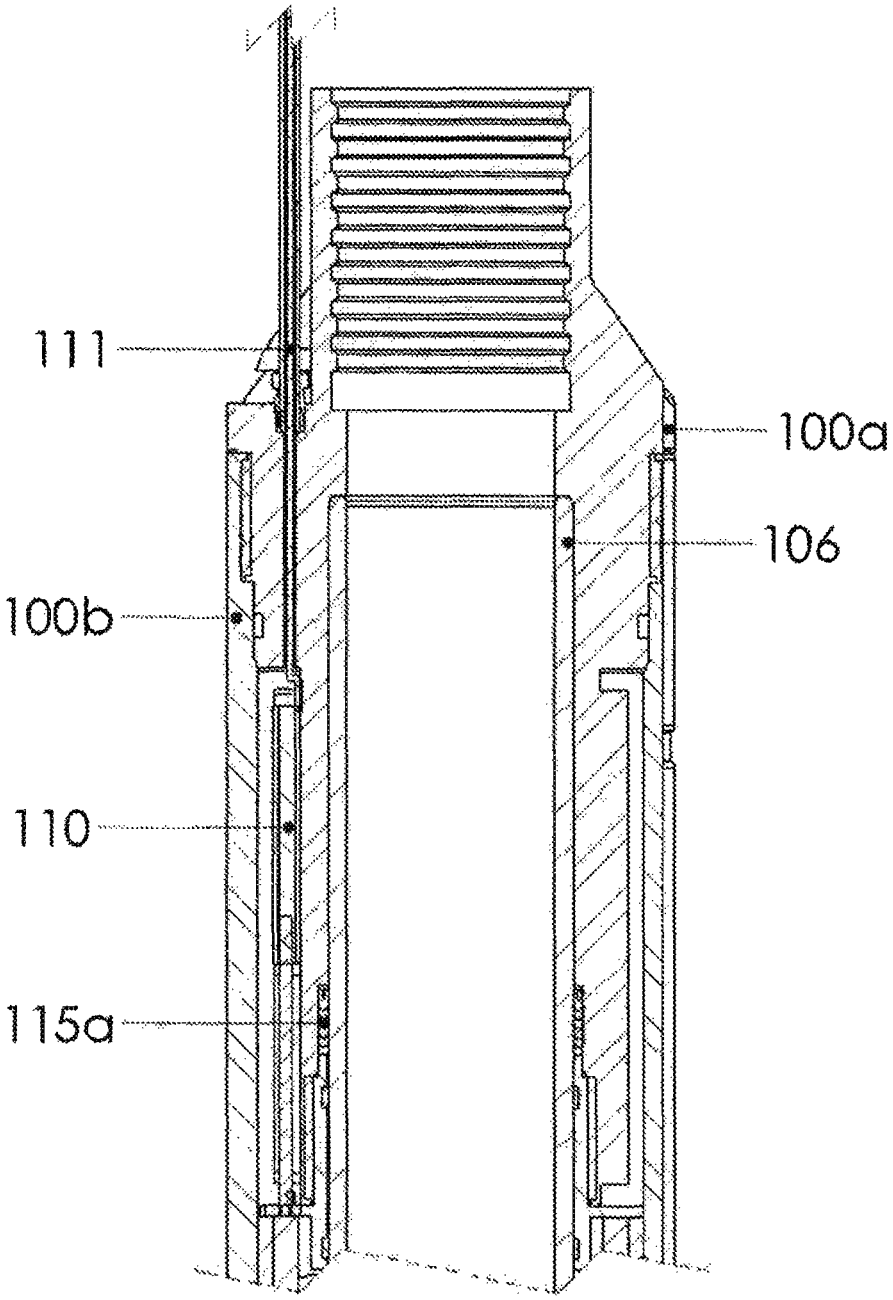
FIGS. 7A and 7B attached are front views, as a detailed cut of the valve of the invention exhibiting the electrical system for control, supply, monitoring and communication in the closed position (FIG. 7A) and in the open position (FIG. 7B).
Figure 7B:
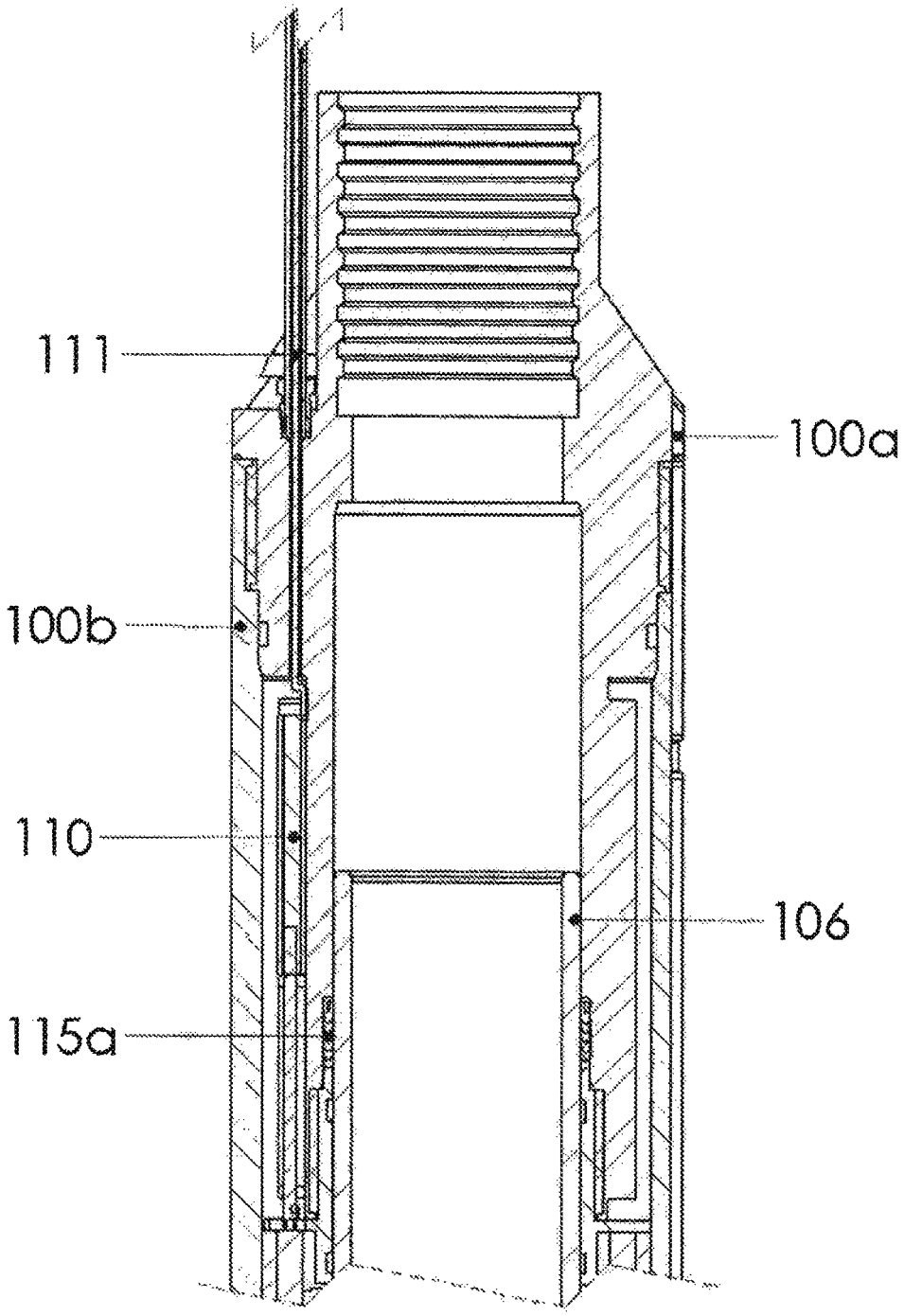

The control of said hollow shaft motor rotor 101*b* is made by at least one control electronics device 110 (FIGS. 7A and 7B) included in at least a high dependability plate installed in the interior of the upper section 100*a* of housing, said electronics 110 being energized with the aid of a TEC cable 111 while being in charge of the operation of the said downhole safety valve 200. (FIG. 7). The use of a second control electronics 110 is also plausible in the invention for the sake of redundance.

The actuation array (FIGS. 8A and 8B)) counts additionally with two roller bearings 109 housed in the intermediate section 100*b* of the housing, there being one axial roller bearing 109*a* and one radial roller bearing 109*b*. The axial roller bearing 109*a* is designed to support the axial charge, the major component of which comes from the spring 107 compression upon opening, while the radial roller bearing 109*b* is designed to keep the alignment of the actuation array.

The interior of the downhole safety valve 200 is sealed by means of two dynamic seals 115 (not being limited to such configuration), a first dynamic seal 115*a* being housed between the upper section 100*a* of the housing and the sliding sleeve 106. As for the second dynamic seal 115*b* (FIGS. 9A and 9B), the second dynamic is housed between the sliding sleeve 106, the lower section 100*c* of the housing and the sealing base 113.

Still, the present invention contemplates that the downhole safety valve 200 should contain additionally an equalizing system (not represented) housed either in the sealing base 113 or in the flapper sealing 108*a*, being actuated in both forms by means of the sliding sleeve 106 movement.

Thus the present invention admits using a device (not represented) for equalizing pressure in the region of the actuation array, understood as the inner space, constrained internally by sliding sleeve 106 and externally by housing 100.

Still, the present downhole safety valve 200 admits optionally temperature, pressure, flow rate and vibration sensors and accelerometers (not represented), not being limited to those, a dedicated electronic (not represented) being designed for said sensors' operation (supply and signals acquisition).

Optionally the control electronics 110 performs the function of operating the present downhole safety valve 200 while at the same time it monitors and supplies the sensors.

Still optionally the control electronics 110 performs the function of providing continuity to the only supply and communication well line, being thus responsible for all of the control, monitoring and communication of the completion string.

Alternatively, the control electronics 110 is not present (on-board) in the said downhole safety valve 200, being positioned at the surface (either off-shore or on land) or in any other location, close or not to the safety equipment, thus making access easier.

In case it is desired, during the operation period, there is the possibility of performing small moves in said sliding sleeve 106 in order to remedy the appearance of scales, hydrates or any other kind of undesirable formation on the said downhole safety valve 200. These small moves are performed by the actuation array, and there is no need to close said sliding sleeve 106 to execute the moves. These vibrations can be induced by alternating the poles of said hollow shaft motor 101.

Alternatively, it is possible to dispose ultrasonic oscillators (not represented) along the body of tool 200. Whenever actuated, these start intermittent oscillations, triggering mechanical vibrations which propagate throughout said downhole safety tool 200. Such vibrations result in the mechanical or thermal removal of scales and undesirable deposits on the tool 200.

In static union regions, metal seals (not represented) are used to improve dependability of the tool 200, this not being a limiting aspect of the scope of the invention.

I claim:

1. An electric downhole safety valve system for flow blockage of oil and gas fluid in a downhole oil and gas flow pipe in case of completion string control loss, said valve system mounted inside said oil and gas downhole flow pipe, said valve system comprising:

a valve system tubular housing having an upper section, an intermediate section, and a lower section, connected end to end;

an electric motor mounted in said valve system tubular housing, and having a hollow cylindrical rotor mounted inside a hollow cylindrical stator;

an axially movable, hollow cylindrical sleeve connected to said cylindrical rotor for axial movement in said valve system tubular housing;

a spring connected movably at one end to said axially movable, hollow cylindrical sleeve for moving said axially movable, hollow cylindrical sleeve axially from a valve open position to a valve closed position when power is removed from said electric motor;

an electric supply cable connected to said electric motor;

a flapper gas and oil fluid flow control valve movable from a closed position to an open position by said axially moveable, hollow cylindrical sleeve axially moved by said electric motor, and to said closed position from said open position by said spring, when said electric motor is turned off;

an axial roller bearing housed in the intermediate section engaging said axially movable, hollow cylindrical sleeve for supporting said sleeve axial charge generated from said spring during opening of the flapper valve by the motion of the electric motor, a major component of charge from said spring compression; and a radial roller bearing engaged with said axially movable, hollow cylindrical sleeve for maintaining alignment of the axial movement of said sleeve;

whereby the flow of said gas and oil fluids through said axially movable, hollow cylindrical sleeve is controlled by the position of said flapper control valve, open or closed, across an interior of a passage of said axially movable, hollow cylindrical sleeve.

2. The electric downhole safety valve system, as in claim 1, including:

a first seal mounted between the housing upper section and an upper exterior area of the axially movable, hollow cylindrical sleeve; and a second seal mounted between a lower exterior area of the axially movable, hollow cylindrical sleeve and the housing lower section.

3. An electric downhole safety valve system for flow blockage of oil and gas fluid in a downhole oil and gas flow pipe in case of completion string control loss, said valve system mounted inside said oil and gas downhole flow pipe, said valve system comprising:

a tubular housing having an upper tubular section, an intermediate tubular section and a lower tubular section integrally formed together as the housing;

a hollow shaft electric motor mounted inside said tubular housing, said hollow shaft electric motor including a stator and a rotor for providing circular torque;

an axially movable cylindrical sleeve mounted inside axially said tubular housing and inside said electric motor rotor;

a rotatable nut attached to said electric motor rotor for rotating said nut;

a spindle threaded and connected to said nut and to said axially movable cylindrical sleeve for moving said axially movable cylindrical sleeve in an axial direction when said electric motor rotor rotates said rotatable nut;

a helical spring mechanically surrounding a portion of an exterior of said axially movable cylindrical sleeve;

a circular flapper valve, connected to an inside said tubular housing lower tubular section, having an open oil and gas flow position and a closed oil and gas flow position, depending on the axial location of said axially movable cylindrical sleeve in a first open position and a second closed position, allowing the circular flapper valve to close oil and gas flow through a bottom end of said axially movable cylindrical sleeve;

said helical spring providing mechanical potential and kinetic energy to said axially movable cylindrical sleeve in the event the hollow shaft electric motor experiences a power loss;

an axial roller bearing housed in the intermediate section of said tubular housing engaging said axially movable sleeve for supporting the sleeve axial charge generated from said spring during opening of the flapper valve by the motion of the electric motor, a major component of charge from said spring compression;

a radial roller bearing engaged with said axially movable sleeve for maintaining alignment of the axial movement of said axially movable cylindrical sleeve;

a first dynamic seal mounted between the housing upper section and an upper exterior area of the axially movable cylindrical sleeve; and a second O-ring seal mounted between a lower exterior area of the axially movable cylindrical sleeve and the housing lower section, whereby the flow of said gas and oil fluids through said axially movable cylindrical sleeve is controlled by the position of said flapper control valve, open or closed, across an interior of said tubular housing lower section, preventing oil and gas flow through said axially movable cylindrical sleeve bottom end.

* * * * *